US010966484B2

(12) United States Patent
Merlo

(10) Patent No.: US 10,966,484 B2
(45) Date of Patent: Apr. 6, 2021

(54) SHOE SOLE AND A SHOE COMPRISING SUCH SOLE

(71) Applicant: JV International S.r.l., Milan (IT)

(72) Inventor: Ambrogio Merlo, Milan (IT)

(73) Assignee: JV INTERNATIONAL S.R.L., Milan (IT)

( * ) Notice: Subject to any disclaimer, the term of this patent is extended or adjusted under 35 U.S.C. 154(b) by 524 days.

(21) Appl. No.: 15/156,915

(22) Filed: May 17, 2016

(65) Prior Publication Data

US 2016/0338446 A1 Nov. 24, 2016

(30) Foreign Application Priority Data

May 18, 2015 (IT) ..... 102015000015601

(51) Int. Cl.

| | |
|---|---|
| ***A43B 13/18*** | (2006.01) |
| ***A43B 13/12*** | (2006.01) |
| ***A43B 13/02*** | (2006.01) |
| ***A43B 13/36*** | (2006.01) |
| ***A43B 13/04*** | (2006.01) |
| ***A43B 13/14*** | (2006.01) |
| ***A43B 13/20*** | (2006.01) |
| ***A43B 13/22*** | (2006.01) |

(52) U.S. Cl.

CPC ..... *A43B 13/186* (2013.01); *A43B 13/026* (2013.01); *A43B 13/04* (2013.01); *A43B 13/12* (2013.01); *A43B 13/127* (2013.01); *A43B 13/141* (2013.01); *A43B 13/187* (2013.01); *A43B 13/188* (2013.01); *A43B 13/20* (2013.01); *A43B 13/223* (2013.01); *A43B 13/36* (2013.01)

(58) Field of Classification Search

CPC ..... A43B 13/186; A43B 13/026; A43B 13/04; A43B 13/12; A43B 13/141; A43B 13/187; A43B 13/188; A43B 13/20; A43B 13/223; A43B 13/36; A43B 13/10; A43B 13/00; A43B 13/122; A43B 13/125; A43B 13/127; A43B 13/16; A43B 13/18; A43B 3/026; A43B 5/002; A43B 5/003; A43B 7/32; A43B 23/08; A43B 23/088; A43B 23/16; A43B 23/17

USPC ..... 36/28, 113, 68, 69

See application file for complete search history.

(56) References Cited

U.S. PATENT DOCUMENTS 4,219,945 A * 9/1980 Rudy ..... A43B 13/203 36/29
4,271,606 A * 6/1981 Rudy ..... A43B 13/223 36/29
4,486,964 A * 12/1984 Rudy ..... A43B 7/1495 36/28
4,506,460 A * 3/1985 Rudy ..... A43B 7/1495 36/28
4,624,061 A * 11/1986 Wezel ..... A43B 5/06 36/102

(Continued)

FOREIGN PATENT DOCUMENTS

EP 1985195 10/2008

*Primary Examiner* — Jameson D Collier
*Assistant Examiner* — F Griffin Hall
(74) *Attorney, Agent, or Firm* — Tutunjian & Bitetto, P.C.

(57) ABSTRACT

The present invention relates to a shoe sole including a first base component, at least one second top component connected to the first base component, as well as at least one third intermediate component, interposed between the first base component and the second top component.

16 Claims, 4 Drawing Sheets

(56) References Cited

U.S. PATENT DOCUMENTS

| | | | | | |
|---|---|---|---|---|---|
| 4,817,304 | A * | 4/1989 | Parker | A43B 13/20 | 36/114 |
| 5,220,737 | A * | 6/1993 | Edington | A43B 1/0072 | 36/28 |
| 5,247,742 | A * | 9/1993 | Kilgore | A43B 5/00 | 36/114 |
| 5,964,046 | A * | 10/1999 | Brooks | A43B 1/0027 | 36/169 |
| 6,023,859 | A * | 2/2000 | Burke | A43B 3/0047 | 36/100 |
| 6,158,149 | A * | 12/2000 | Rudy | A43B 7/144 | 36/29 |
| 7,013,581 | B2 * | 3/2006 | Greene | A43B 7/08 | 36/114 |
| 7,181,867 | B2 * | 2/2007 | Litchfield | A43B 13/203 | 36/141 |
| 8,127,468 | B2 * | 3/2012 | Morgan | A43B 13/12 | 12/142 T |
| 2002/0050077 | A1 * | 5/2002 | Wang | A43B 5/00 | 36/28 |
| 2006/0010716 | A1 | 1/2006 | Kerns et al. | | |
| 2007/0277401 | A1 * | 12/2007 | Young-Chul | A43B 13/186 | 36/30 R |
| 2009/0260259 | A1 * | 10/2009 | Berend | A43B 7/24 | 36/88 |
| 2014/0075777 | A1 * | 3/2014 | Bruce | A43B 7/144 | 36/29 |
| 2014/0109440 | A1 * | 4/2014 | McDowell | A43B 9/00 | 36/103 |
| 2015/0196085 | A1 * | 7/2015 | Westmoreland | A43B 13/026 | 36/87 |
| 2016/0302517 | A1 * | 10/2016 | Jessiman | A43B 13/187 | |
| 2016/0324264 | A1 * | 11/2016 | Johnson | A43B 23/0245 | |

* cited by examiner

SHOE SOLE AND A SHOE COMPRISING SUCH SOLE

TECHNICAL FIELD OF THE INVENTION

The present invention relates to a shoe sole as well as a shoe comprising such sole.

STATE OF THE PRIOR ART

To date, many shoe soles have been proposed, which generally comprise a more or less complex structure, and usually with a higher or lower hardness based on the user's needs and the activity for which they are provided.

The soles commonly used or conceived are generally too "soft" or too "rigid".

To this regard, the soles which are too soft are comfortable to wear and do non stiffen and excessively prevent the user's foot mobility, but in the case they meet or are over a ground roughness, such as a rock, they deform without being able to guarantee a dumping such to prevent the transmission of the deformation to the user's foot.

Instead, the soles which are too rigid, if on one side they dampen or, de facto, protect the respective foot of a user from any deformation caused by ground roughnesses, they cannot be used in a comfortable and desired way.

US2009260259A1, US2006010716A1 and EP1985195A1 teach respective solutions according to the state of the art.

SUMMARY OF THE INVENTION

One object of the present invention is that of providing a new shoe sole.

Another object of the present invention is that of providing a new shoe sole which is able to perfectly adapt even to irregular grounds, as well as to the roughnesses thereupon.

Another object of the present invention is that of providing a new sole, which is suitable for inferiorly deforming in a localized manner, thereby preventing the transmission of the deformations encountered to a user's foot.

Another object of the present invention is that of providing a sole capable of providing stability, traction ad adherence in any situation.

Another object of the present invention is that of providing a new shoe provided with a sole as above.

According to one aspect of the invention, a sole is provided according to the present principles.

The present application refers to preferred and advantageous embodiments of the invention.

BRIEF DESCRIPTION OF THE DRAWINGS

Other features and advantages of the invention will be more apparent by the description of embodiments of a sole and a shoe, given by way of example in the accompanying drawings, wherein.

In the accompanying drawings equal parts or portions are marked with the same reference numbers.

DETAILED DESCRIPTION

Figure 1:
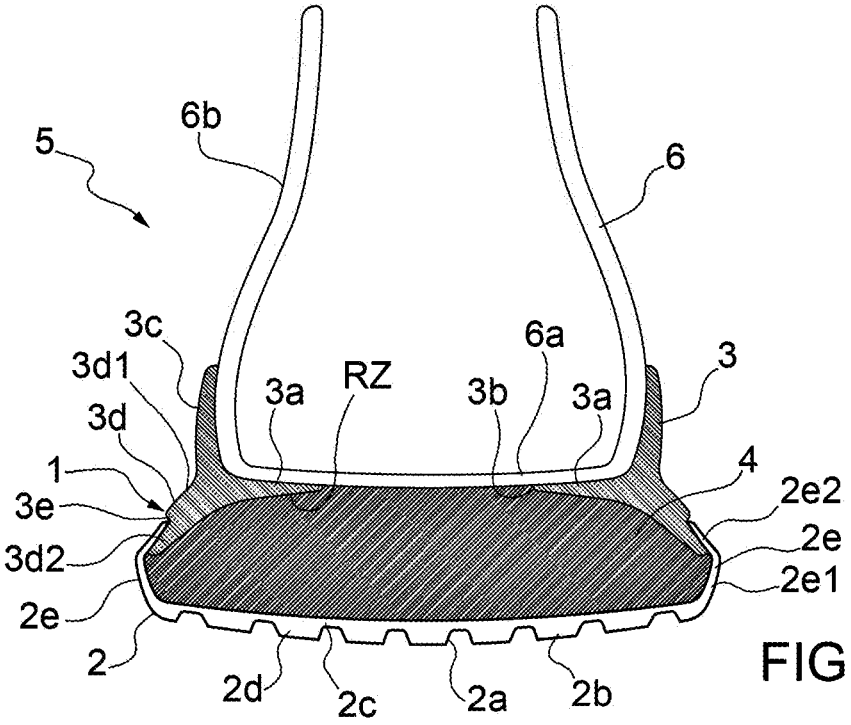
FIG. 1 is a partially cross sectional view of an embodiment of a sole and a shoe according to the present invention.
Figure 2:
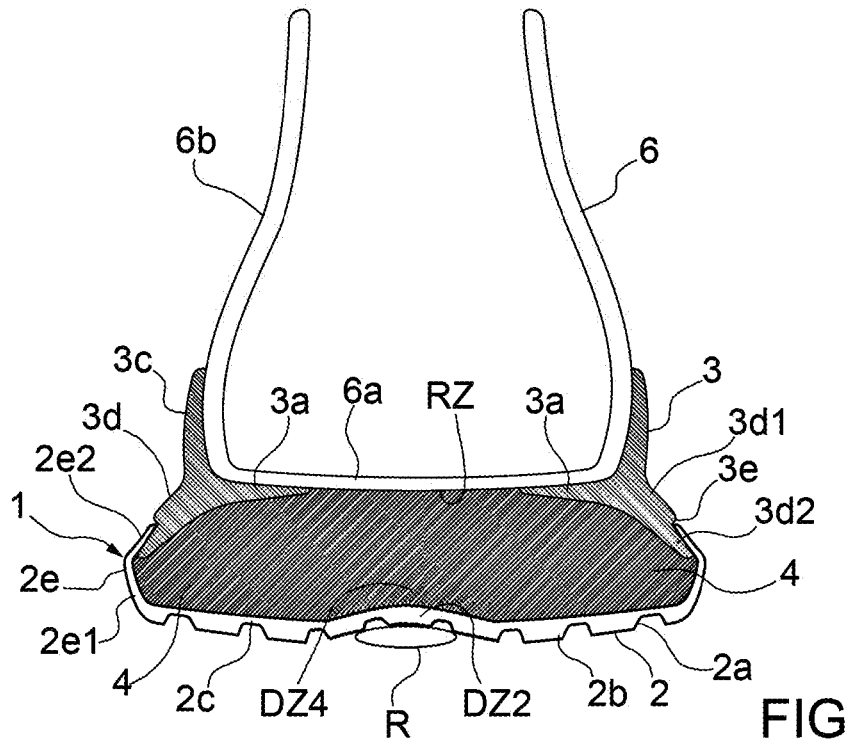
FIG. 2 is a view of the sole and the shoe of FIG. 1 during the engagement of a ground roughness.

With reference to FIGS. 1 and 2, a shoe sole 1 according to the present invention is illustrated, which comprises a first base component 2 presenting a first tread lower surface 2*a* including a plurality of blocks 2*b*, as well as a second upper surface 2*c*.

The first component 2 can be made of a material selected from the group comprising natural or synthetic elastomers, thermoplastic materials, thermosetting materials and rubbers. Moreover, the first base component 2 can be reinforced or not, for example reinforced by means of unidirectional fibres, woven or non-woven fabrics, natural fibres, synthetic fibres, metal fibres, aramid fibres, glass fibres, carbon fibres and/or composite fibres.

The sole then comprises a second top component 3 connected to the first base component 2, preferably directly connected, i.e. with reciprocal parts, in particular edge parts, in contact with each other and, thus, preferably without interposition of other components or elements of the sole. According to a variant, between the first component 2 and the second 3 component or, better, between respective edge portions, the lower portion of an upper 6 could be placed, for example, moulded.

To this regard, the first 2 and the second 3 component can be connected in a removable way (for example in order to disassemble and replace the third component, which will be discussed below), if desired through hinges, joints or mechanical couplings (shape engagements, fit insertions, interlocking, etc.) or can be fixed to one another, if desired with a glue or through welding.

The second top component 3 is preferably made of a rigid ore semi-rigid material and is designed to guide the foot of a user during the movement as well as to allow a controlled foot torsion in the various directions.

The second top component 3 can be made of a single material or a plurality of materials, if desired EVA (ethylene-vinyl acetate) with hardness equal to 80-90 shore C degrees, or of thermoplastic polymers, such as TPU (thermoplastic polymer), with hardness equal to 60-70 shore D degrees. Moreover, such component 3 can be made of several parts or be in a single piece.

The second component 3 has the function of providing stability as well as flexibility to the respective sole and shoe. Such second component 3 performs the function of guiding the foot during the walk/run or movement and allows, at the same time, a controlled torsion in the various directions. To this regard, the second component 3 could be so as to provide a uniform or non-uniform resistance to bending, with the meaning that it could be such to withstand to bending following sole movements or deformations along established directions, and not to withstand or however not to oppose resistance to bending along other directions or it could show different resistance to deformation in respective different parts.

The sole 1 is then provided with at least one third intermediate component 4 placed between the first base component 2 and the second top component 3 or better in a receiving zone RZ delimited by the same, if desired with part of an upper 6.

The third intermediate component 4 has an hardness lower that the second top component 3 and is designed to control and dissipate the deformation of the first base component 2, so as to prevent or reduce the deformation propagation from the first base component 2 to the second top component 3, and then to the user foot wearing the sole 1, or better the respective shoe 5. The third intermediate component 4 is advantageously made of an expanded, light and with a low density material.

To this regard, the first base component 2 is such to deform in a localized manner when it engages an obstacle or a roughness R (see FIG. 2), while the third intermediate component 4 is such that, when the first component 2 is deformed, it undergoes a localized and limited deformation, in particular close to the deformation zone of the first component 2, which deformation is not transmitted to the second component 3 or to the bottom wall 6*a* of the respective upper 6.

In essence, the third component 4 is designed to support the body weight of a user on the second component 3 and to prevent the pressing of the latter, controlling at the same time the first component 2 deformation, so as to keep the latter substantially in the correct shape when it engages a roughness R on the ground.

The third component 4 preferably comprises an elastomer (more or less expanded) of organic or inorganic nature, for example EVA or PU with different degrees of resilience and compression hysteresis. Alternatively, the third component could be a fluid, such as a gas, in that case the receiving zone of the same would be fluid or gas tight.

Moreover, the third component 4 can comprise, as will be better said below, two or more layers coupled with each other, both one over the other or side by side.

The third component 4 is not glued to the first 2 and the second 3 component. To this regard, the third component 4 is in any case, preferably, in contact with the respective internal faces of the first 2 and second 3 component. Moreover, the third component 4 could be coated by means of a suitable lubricant.

According to a particularly advantageous embodiment:

- the first component 2 comprises a rubber with thickness between 1.5 and 0.9 mm, blocks with thickness of about 8 mm, density equal to 1,100 to 1,200 kg/m$^3$, Shore hardness of 55-75 A.
- the second component 3 comprises EVA, with thickness between 6 and 10 mm, Shore hardness of 50-85 C, resilience 14-17 J/m$^2$ and compression equal to 8-12%; and
- the third component 4 has a thickness between 4 and 8 mm, Shore hardness equal to 20-40 C, resilience equal to 18-21 J/m$^2$ and compression equal to 5-10%.

As regard, then, the compression, the measure unit thereof is the percentage of deformation with respect to the initial thickness subjected to a force of 1.8 KN for a determined time period at a determined temperature.

According to the present invention, a shoe 5 is then provided, comprising a sole 1.

The shoe 5 comprises an upper 6, which is connected to the second top component 3 and, if desired at the top of the third intermediate component 4.

If desired, the upper 6 delimits, together with the first 2 and the second 3 component a receiving zone RZ of the third component 4.

A sole according to the present invention is capable of adapting and deforming correctly at a ground roughness R, so as to "copy" or match in a complementary manner to such roughness R.

To this regard, should the shoe 5 rest on a roughness R (during a walk, a run, etc.), the third component 4 would deform at a respective second deformation zone DZ4 close to the first deformation zone DZ2 of the first component 2, thereby allowing a controlled and localized deformation of the first component 2, but without transferring the deformation to the second component 3 or to the bottom wall 6*a* of the upper 6 and, thus, to the user's foot; that is to say that the second deformation zone DZ4 is in any case confined and not extended for the entire height or thickness of the third component 4, so as not to involve the second component 3 or the bottom wall 6*a* of the upper 6 or anyway, the user's foot.

This assures a higher adherence to the ground and a reduced wear of the tread layer 2*a* of the first base component 2, this because the surface of a sole 1 according to the present invention in contact with a roughness R is actually larger than the traditional soles, wherein the deformation of the respective tread is [nor] not controlled and is not such as to allow an adjustment complementary to the roughness R. Thus, given the same applied forces, the contact surface of a sole according to the present invention is higher than the soles according to the state of the art and guarantees a lesser wear than that of the present invention.

With reference now, in particular, to the not limiting embodiment shown in FIGS. 1 and 2, the first component 2 shows a substantially C cross-sectional configuration, with a flat or substantially flat intermediate section 2*d*, as well as one or more lateral sections 2*e* extending upwards, in use, starting from an outer edge of the intermediate section. The lateral section 2*e* can comprise a substantially annular section extending upwards from the outer edge of the intermediate section 2*d* for the entire sole perimeter, i.e. from the front to the rear and along the sides of the same.

The first tread lower surface 2*a* and the second upper surface 2*c* are provided only at the intermediate section 2*d*, while the annular section 2*e* is not provided with blocks 2*b*.

The annular section or each lateral section 2*e* can show a first lower length 2*e*1, extending upwards from the outer edge of the intermediate section 2*d* and is substantially tapered or anyway with distance from the sole centre-line decreasing when approaching the intermediate section 2*d*, as well as a second upper length 2*e*2, extending upwards from the edge of the first lower length 2*e*1, and is substantially tapered or anyway with distance from the sole centre-line decreasing when moving away from first lower length 2*e*1.

Alternatively, the annular section or the lateral sections 2*e* can have a substantially curved configuration with concavity facing toward the inside of the sole 1 or the receiving zone RZ of the third component 4.

The first component 2 is basically composed of a plate made in a single piece, with substantially constant thickness, even if it can have lateral sections 2*e* with thickness lower than the intermediate section 2*d*.

The second component 3 can have, instead, a base wall 3*a*, if desired substantially flat and annular or delimiting a central through or, alternatively, not annular opening 3*b*.

The second component 3 can comprise also a first tubular or annular wall or one or more first lateral walls 3*c* extending upwards, in use, from the outer edge of the base wall 3*a*. The first tubular or lateral wall 3*c* can extend, for example, substantially at right angle with respect to the base wall 3*a*.

The second component 3, if desired, is provided with a second tubular or annular wall or one or more second lateral walls 3*d*, extending downwards, in use, from the outer edge of the base wall 3*a*. The second tubular or lateral wall 3*d* can extend, for example, substantially at obtuse angle or inclined or slightly curved with respect to the base wall 3*a*, so as to be tapered or with distance from the sole centre-line decreasing when approaching the base wall 3*a*.

The upper, in use, end of the first component 2 is enclosing and abutting as well as in connection on the second tubular or lateral wall 3*d*.

Moreover, the second tubular or lateral wall 3*d* can show a first portion 3*d*1 having higher width, and then a second portion 3*d*2 having lesser width so as to delimit a step or shoulder 3*e* external or facing the outside of the sole 1. In that case, the upper, in use, end of the first component 2, for example the upper, in use, end of the annular section 2*e*, for example of the second upper length 2*e*2 of the latter, is enclosing and abutting as well as connected (for example welded or glued) on the second tubular or lateral wall 3*d*, for example on the second portion 3*d*2 of the latter.

The first 3*c* and/or the second 3*d* tubular wall extend for the entire sole perimeter, that is to say from the front to the rear and along both sides of the same.

Alternatively to a first and a second tubular wall, respective sections of lateral walls can be provided, extending from respective perimeter portions of the base wall 3*a*, for example two sections of first lateral wall and two sections of second lateral wall, each extending along a respective side of the sole.

The third component 4, instead, is placed in a receiving zone RZ delimited by the internal face of the first component 2, which is defined by the internal face of the intermediate section 2*d* and the annular section or lateral sections 2*e*, and by the internal and lower face of the second component 3 or, better, by the internal and lower face of the base wall 3*a* and of the second tubular or lateral wall 3*d*.

In such case, if the base wall 3*a* is annular, then the receiving zone RZ is delimited also by part of the upper 6 or by a bottom wall 6*a* of the same, otherwise the receiving zone RZ is delimited only by the components now indicated.

Anyway, the third component 4 advantageously substantially fills the receiving zone RZ or however it is in contact against the internal face of the first component 2 or the inner face facing, in use, downwards of the second component 3, this is to say that the third component 4 engages and abuts in a substantially continuous way against all the faces delimiting the respective receiving zone RZ.

With reference more in detail to the upper 6, the upper can be housed and connected (glued, sewed, etc.) to the second component 3, for example with a portion housed inside the cradle zone delimited by the internal and upper face of the second component 3 or, better, by the internal and upper face of the base wall 3*a* and of the first tubular or lateral wall 3*c*.

More particularly, the upper 6 comprises a bottom wall 6*a* placed resting on the internal and upper face of the second component 3, for example of the base wall 3*a*, as well as a tubular lateral wall 6*b* extending upwards from the outer edge of the bottom wall 6*a*.

In FIG. 1 a sole and a shoe according to the present invention have been shown, with third intermediate component 4 having a single substantially plate-shaped layer. Such solution is particularly suitable for the use in urban area (on cement or asphalt). A single layer third component 4 allows for a high absorption of impacts and guarantees a good elastic return particularly indicated for high performances on homogeneous surfaces.

Figure 3:
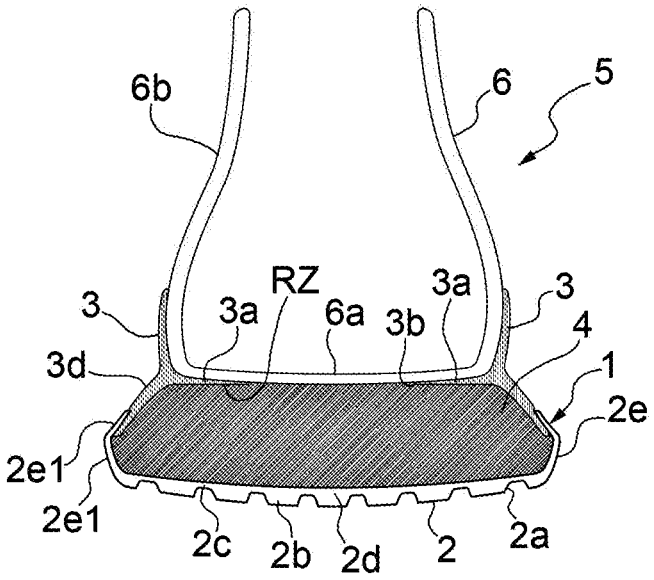
FIGS. 3 to 5 are views similar to FIG. 1 of other embodiments of sole and shoe according to the present invention.

With reference to FIG. 3 a sole similar to that in FIG. 1 is shown, but with second component 3 having a slightly lower thickness than the sole described above, which clearly guarantees a greater lightness, even if slightly more limited stability.

Figure 4:
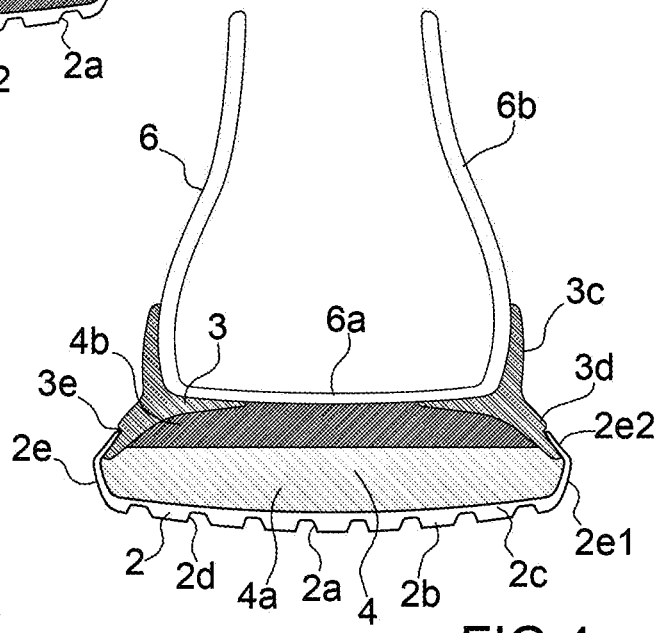

FIG. 4, instead, regards a sole with third component 4 made of two overlapping plate-like elements 4*a*, 4*b*. Such plate-like elements are, then, one 4*a* lower, in use, and the other 4*b* upper, in use and resting, for its entire width, on the lower plate-like element 4*a*. In essence, thus, a bottom face of the upper plate-like element 4*b*, if desired substantially flat, is resting on a top face of the lower plate-like element 4*a*. The two plate-like elements 4*a*, 4*b* can be fixed with each other (if desired glued or welded or moulded one over the other) or disengaged.

The lower plate-like element 4*a* shows, for example, density different from the upper plate-like element 4*b*.

Thanks to such expedient, the sole is in particular suitable for the use (walk, running) on uneven grounds, guaranteeing however an excellent stability, traction and adherence. In that case, it is possible to obtain the first component 2 and the lower layer element 4*a* so that they are very deformable, without transferring, however, a deformation to the upper layer element 4*b* and, thus, the user.

Figure 5:
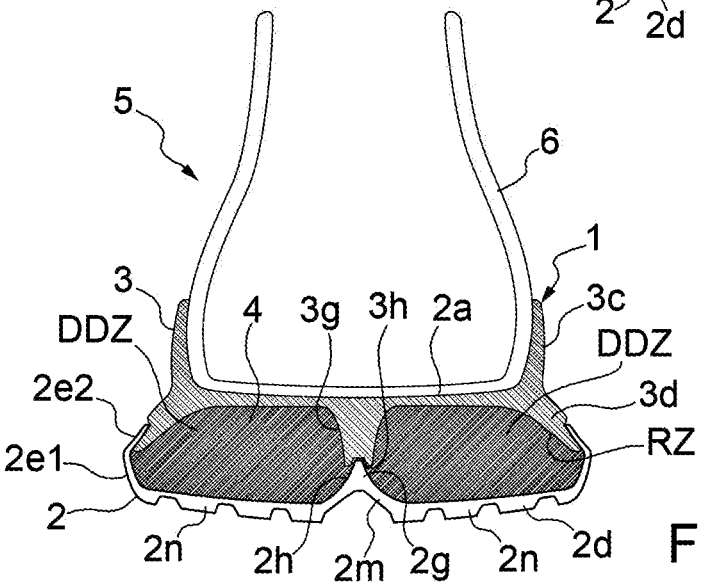

Instead, the embodiment illustrated in FIG. 5 comprises one or more ribs 2*g* and/or shank sections 3*g* extending from the internal face, in particular from an intermediate portion of the same, of the intermediate section 2*d* facing the base wall 3*a* or of the base wall 3*a* (in that case, preferably, annular) facing the intermediate section 2*d*.

The rib/s 2*g* and/or the shank sections 3*g* extend/s within the receiving zone RZ of the third component/s so as to delimit or split, actually, the sole in one or more differentiated deformation zones DDZ. In each zone a respective third intermediate component 4 can be placed or the same component 4 can extend and be housed in all the differentiated deformation zones DDZ.

To this regard, according to the embodiment shown in the figures, the sole provides for each rib 2*g* a respective shank section 3*g*, i. e. a shank section vertically, in use, substantially aligned to the respective rib 2*g*, in such a way that by deforming the first component 2 an abutment of the rib 2*g* or of a tip 2*h* thereof is obtained on the shank section 3*g* or on a free end of the same. Moreover, the rib or the ribs 2*g* can comprise a tip 2*h* intended to be slidingly or loosely (that is not to size) housed in a groove 3*h* formed in the free end of the or of a respective shank section 3*g*, so that the tip 2*h* of the rib 2*g* is slidably housed inside the groove 3*h* of the shank section 3*g*, thereby promoting the engagement between the rib 2*g* and respective shank section 3*g*, after the deformation of the first component 2, if desired, once the same engages a roughness R on the ground.

The rib/s 2*g* and/or the shank section/s 3*g* extend, for example, substantially parallel to the sole direction F-R, that is along the longitudinal axis of the sole or transversally or orthogonally to such direction.

Figure 6:
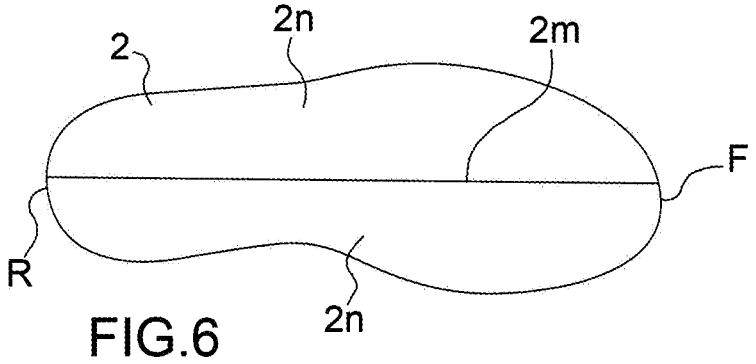
FIGS. 6 to 10 are bottom views of respective embodiments of a sole according to the present invention.
Figure 7:
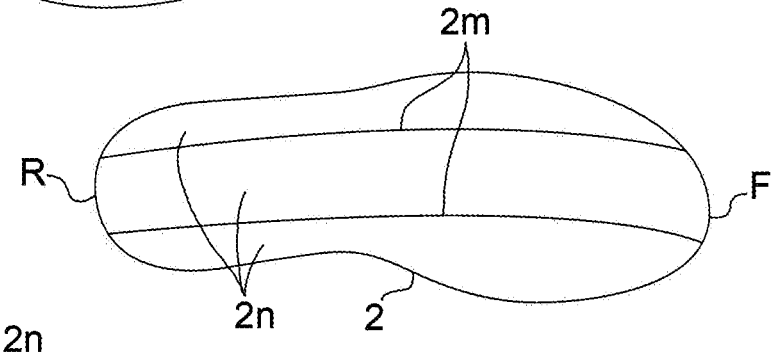
Figure 8:
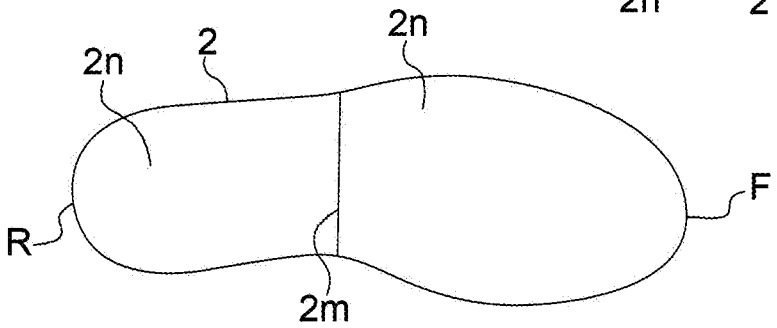
Figure 9:
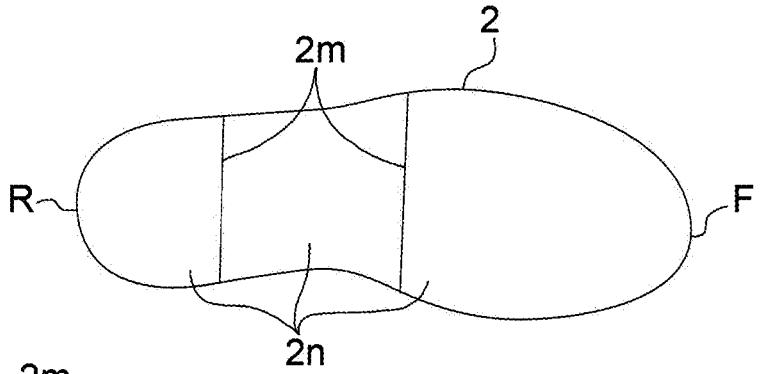
Figure 10:
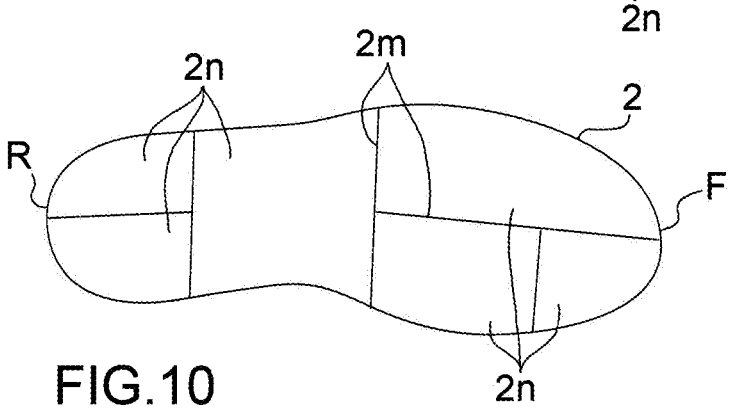

The rib/s 2*g* and/or the shank section/s extend, for example, substantially parallel to the sole direction F-R (see for example FIGS. 6 and 7), or transversally or orthogonally to such direction (see FIG. 8 or 9) and, of course, there may be combinations of such solutions (see FIG. 10).

The rib 2*g* can be formed through a folded or curved portion of the first component 2, so as to delimit a respective groove 2*m* open toward the outside of the first component 2, and thus, in use, downwards. In essence, in that case, the base component 2 has one or more grooves 2*m*, each substantially aligned with a respective rib 2*g*, so that it shows for each differentiated deformation zone DDZ a respective substantially flat or slightly curved section 2*n* of the first component 2, designed to come into contact with the ground, which section is separated from the substantially flat or slightly curved sections 2*n* of the other differentiated deformation zones.

Moreover, the rib/s 2*g* and/or the shank section/s 3*g* can be designed to provide a stopping point or stop line of the deformation of the first component 2.

To his regard, in fact, when the first component 2, during the run or the walk, engages or passes over a roughness R, it would deform, this causing, as a result of a predetermined deformation, the impact of the rib 2*g* or a shank section 3*g* on the surface facing thereto of the second 3 or first 2 component.

Figure 11:
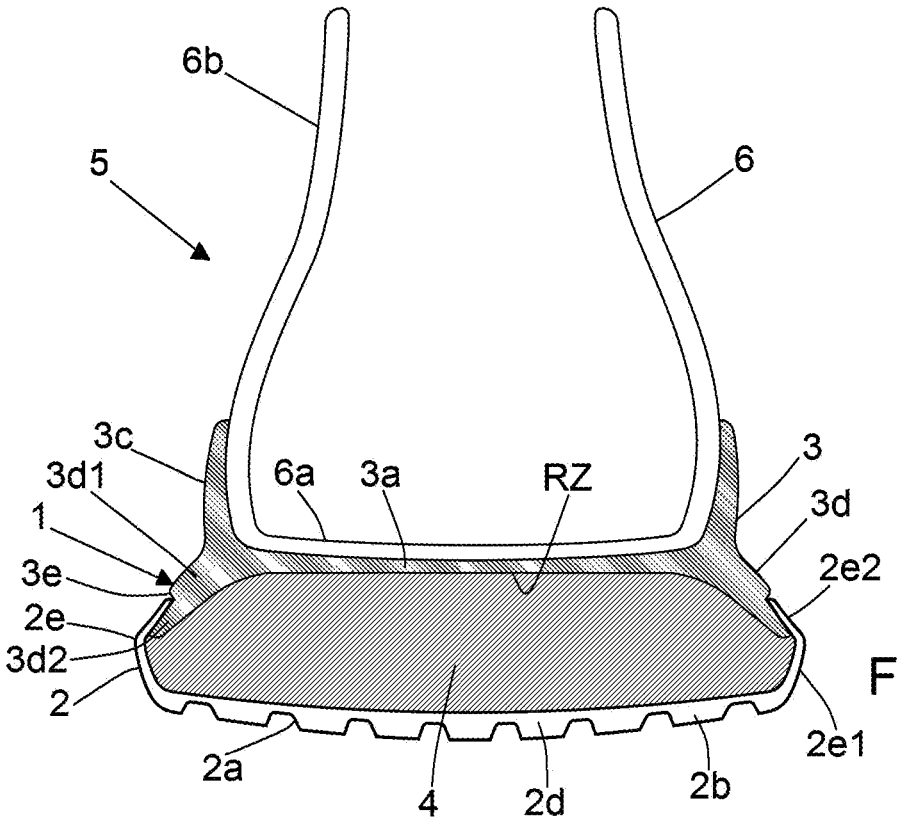
FIGS. 11 and 12 are views similar to FIG. 1 of other embodiments of sole and shoe according to the present invention.

With reference to the embodiment of FIG. 11, it comprises one sole 1 and one shoe 5 similar to those of FIG. 1, but wherein the receiving zone RZ of the third intermediate component 4 is delimited only between the first base component 2 and the second top component 3, so that the intermediate component 4 is completely enclosed between the first 2 and the second 3 component, hence the intermediate component 4 does neither enter in direct contact with the upper 6 nor with the user's foot.

In that case, the base wall 3*a* of the second component 3 would not be annular and would not delimit any central through opening.

Figure 12:
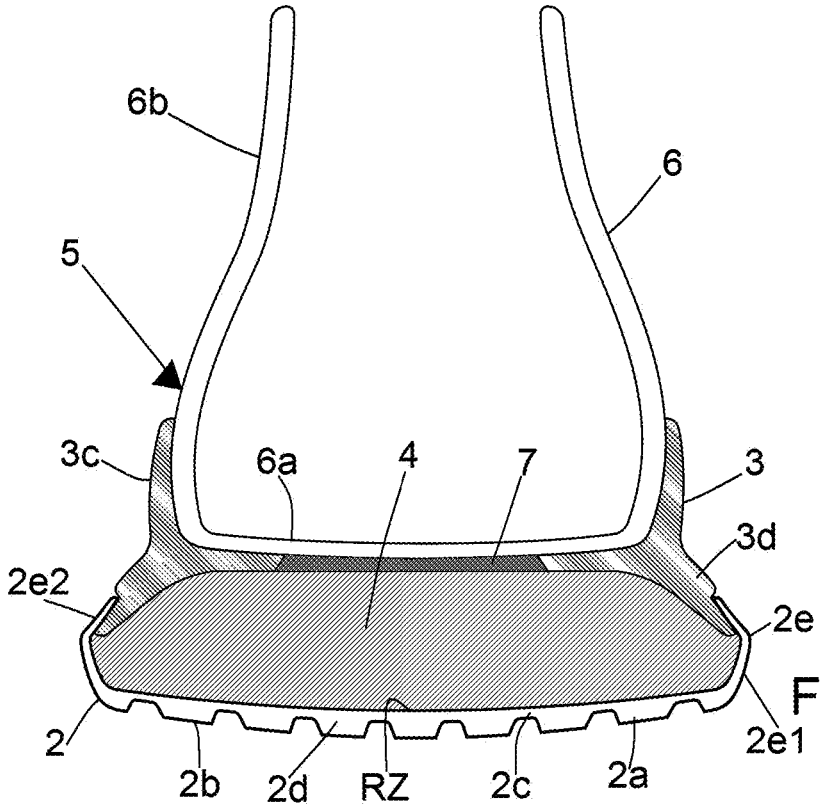

Alternatively, see for example the embodiment illustrated in FIG. 12, the top component 3 could have an annular base wall 3*a* and the sole could comprise also an intercepting member or filter 7 placed inside and substantially filling a central through opening 3*b* delimited by the base wall 3*a*.

According to such variant, the receiving zone RZ of the third intermediate component 4 is delimited only by first component 2, second component 3 and intercepting member or filter 7, so that the intermediate component 4 is completely enclosed between the first component 2, the second component 3 and intercepting member or filter 7.

The intercepting member or filter 7 would be, in that case, designed to isolate, together with the first 2 and second 3 component, the intermediate component 4 with respect to the upper 6 and the foot of a user.

As it will be understood, a sole according to the present invention is capable of optimally adapting to uneven ground as well as the roughnesses present on the same, and can deform lowerly in a localized manner, without transferring deformations to the user's foot.

Moreover, a sole according to the present invention is also stable and has high traction and adherence thanks to the combination of above illustrated components.

A sole according to the present invention has in essence an operation similar to that of a tyred wheel, wherein the base component corresponds to a pneumatic tyre, the top component to a wheel rim and the intermediate component to an inner tube.

With reference to the solutions according to the state of the art, it is noted that the same do not teach a sole and a shoe as those according to the present invention.

To that regard, as far as US2009260259A1 is concerned, it teaches a solution having an external sole, an intermediate sole and a plate-like support group extending up to the external sole. US2009260259A1 does not specify that the plate-like support group is in a material harder than the intermediate sole.

Moreover, as it will be noted, the plate-like support group includes lateral fins, extending up to the external sole and enclose partly the intermediate sole, so that the intermediate sole is not able to prevent or reduce the propagation of deformations from the outer sole to the plate-like support group, but instead, every stress imparted to the external sole, is transferred unchanged, through the fins, to the plate-like support group and, thus, to the user's foot.

Modifications and variations of the invention are possible within the scope of protection defined by the claims.

The invention claimed is:

1. A shoe sole including:

a first base component having a first tread lower surface including a plurality of blocks, and a second upper surface;

at least one second top component connected to said first base component, as well as at least one third intermediate component interposed between said first base component and said second top component, wherein said second top component has a base wall, at least one first side wall extending upwards from an outer edge of said base wall, and at least one second side wall extending downwards from the outer edge of said base wall at an inclined angle with respect to the base wall, wherein said at least one third intermediate component has a hardness lower than said second top component and is intended to control and dissipate [the] deformation of said first base component, so as to prevent or reduce the propagation of deformations from said first base component to said second top component, wherein said first base component comprises rubber with thickness between 1.5 and 0.9 mm, blocks with thickness of about 8 mm, density equal to 1,100 to 1,200 kg/m$^3$ and a Shore hardness of 55-75 A;

said second top component comprises EVA, with thickness between 6 and 10 mm, a Shore hardness of 50-85 C, resilience equal to 14-17 J/m$^2$ and compression equal to 8-12%; and said at least one third intermediate component has a thickness between 4 and 8 mm, a Shore hardness equal to 20-40 C, resilience equal to 18-21 J/m$^2$ and compression equal to 5-10%.

2. A sole according to claim 1, wherein said first base component is such as to deform in a localized manner when it engages an obstacle or roughness, while said at least one third intermediate component is such that, when said first component is deformed, said at least one third intermediate component undergoes a localized and contained deformation that is not transmitted to said second top component or to a bottom wall of a respective upper.

3. A sole according to claim 1, wherein said second top component is made of a rigid or semi-rigid material and is intended to guide the foot of a user during movement as well as to allow a controlled torsion of the foot in various directions.

4. A sole according to claim 3, wherein said second top component is formed of a single material or of a plurality of materials and wherein said second top component is made of several parts or is in a single piece.

5. A sole according to claim 1, wherein said first base component and said second top component are removably connected by means of hinges, joints or mechanical couplings, so as to allow the disassembling and replacement of said third intermediate component.

6. A sole according to claim 1, wherein said first base component and said second top component are fixed to one another.

7. A sole according to claim 1, wherein said at least one third intermediate component comprises an elastomer of organic or inorganic nature.

8. A sole according to claim 1, wherein said at least one third intermediate component comprises two or more layers coupled to one another one above the other and/or one next to the other.

9. A sole according to claim 1, wherein said first base component is made of a material selected from the group comprising natural or synthetic elastomers, thermoplastic materials, thermosetting materials and rubbers.

10. A sole according to claim 9, wherein said first base component is reinforced by means of unidirectional fibres, woven or non-woven fabrics, natural fibres, synthetic fibres, metal fibres, aramid fibres, glass fibres, carbon fibres and/or composite fibres.

11. A sole according to claim 1, wherein said at least one third intermediate component is not fixed to said first base component and is not fixed to said second top component, and wherein said at least one third intermediate component is in contact with respective inner faces of said first base component and said second top component.

12. A sole according to claim 1, wherein said at least one third intermediate component is coated with a lubricant.

13. A sole according to claim 1, wherein a receiving zone of the said third intermediate component is disposed only between said first base component and said second top component.

14. A shoe comprising a sole according to claim 1 as well as an upper, said upper being connected to said second top component.

15. A shoe according to claim 14, wherein said upper delimits together with said first base component and said second top component a receiving zone of said at least one third intermediate component.

16. A sole comprising:

a first base component having a first tread lower surface including a plurality of blocks, and a second upper surface;

at least one second top component connected to said first base component, as well as at least one third intermediate component interposed between said first base component and said second top component, wherein said second top component has a base wall, at least one first side wall extending upwards from an outer edge of said base wall, and at least one second side wall extending downwards from the outer edge of said base wall at an inclined angle with respect to the base wall, wherein said at least one third intermediate component has a hardness lower than said second top component and is intended to control and dissipate [the] deformation of said first base component, so as to prevent or reduce the propagation of deformations from said first base component to said second top component, wherein said first base component has a flat or substantially flat intermediate section, as well as a plurality of lateral sections extending upwards, in use, starting from an outer edge of said intermediate section, and wherein an upper end of said first base component is connected to said at least one second side wall.

* * * * *